US009366494B2

(12) United States Patent
Hines

(10) Patent No.: US 9,366,494 B2
(45) Date of Patent: Jun. 14, 2016

(54) STACKED ORDNANCE SYSTEMS AND METHODS

(71) Applicant: Stephen Charles Hines, Edgewood, NM (US)

(72) Inventor: Stephen Charles Hines, Edgewood, NM (US)

(73) Assignee: Falcon Industries, Inc., Edgewood, NM (US)

( * ) Notice: Subject to any disclaimer, the term of this patent is extended or adjusted under 35 U.S.C. 154(b) by 0 days.

(21) Appl. No.: 14/606,719

(22) Filed: Jan. 27, 2015

(65) Prior Publication Data

US 2015/0362275 A1 Dec. 17, 2015

Related U.S. Application Data

(60) Provisional application No. 61/931,935, filed on Jan. 27, 2014.

(51) Int. Cl.
*F41A 21/06* (2006.01)

(52) U.S. Cl.
CPC ..... *F41A 21/06* (2013.01)

(58) Field of Classification Search
CPC ..... F41F 1/08; F41F 1/10; F42B 5/035; F41A 21/06; F41A 21/08
USPC ..... 89/1.41; 42/76.01, 76.1
See application file for complete search history.

(56) References Cited

U.S. PATENT DOCUMENTS

| | | | | | |
|---|---|---|---|---|---|
| 7,547 | A * | 8/1850 | Pannabecker | C21D 7/12 | 42/76.01 |
| 30,332 | A | 10/1860 | Lindsay | | |
| 2,360,217 | A * | 10/1944 | Francis | F41A 1/02 | 42/76.01 |
| 3,815,271 | A | 6/1974 | Lynn | | |
| 3,854,231 | A | 12/1974 | Broyles | | |
| 5,133,260 | A | 7/1992 | Grosch | | |
| 6,138,395 | A * | 10/2000 | O'Dwyer | F41A 25/12 | 42/84 |
| 6,715,398 | B2 | 4/2004 | O'Dwyer | | |
| 7,191,558 | B1 * | 3/2007 | Conroy et al. | F42B 5/24 | 42/76.01 |
| 7,451,702 | B1 | 11/2008 | Dindl et al. | | |
| 7,934,332 | B2 * | 5/2011 | Briggs | F41A 21/02 | 29/520 |

* cited by examiner

*Primary Examiner* — Bret Hayes
(74) *Attorney, Agent, or Firm* — Richard Krukar; Kermit D. Lopez; Luis M. Ortiz

(57) ABSTRACT

A stacked ordnance device provides a disposable and optionally non-reusable projectile weapon. A gun barrel can be formed by holding two half barrels together such that separating the halves exposes the length of the bore. Stacked ordnance devices have multiple projectiles, seals, and charges positioned sequentially in the gun barrel. A controller can electronically trigger igniters that ignite the charges and fire the projectiles. The device can have more than one gun barrel and the gun barrels can be made from plastic. Multi-barrel devices can have gun barrels arranged radially around and damped to a backbone.

13 Claims, 7 Drawing Sheets

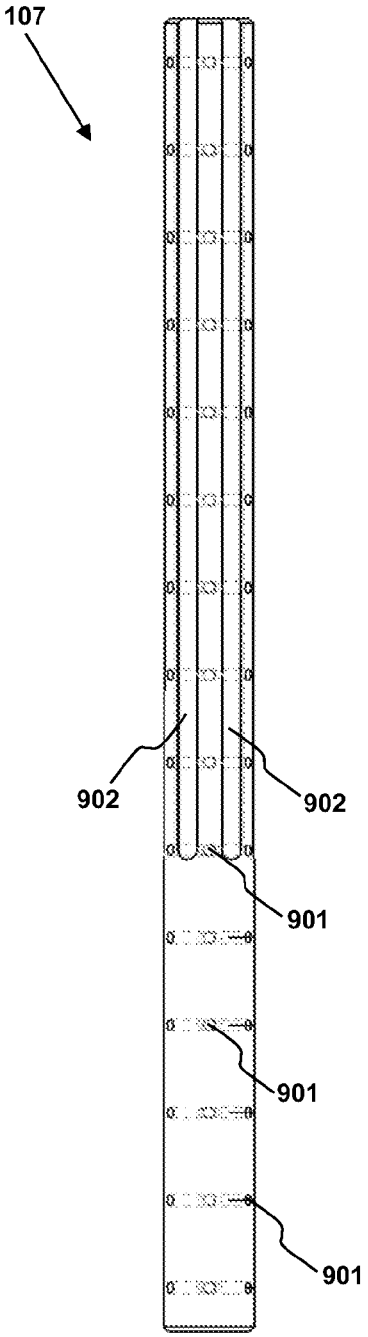
Fig. 9
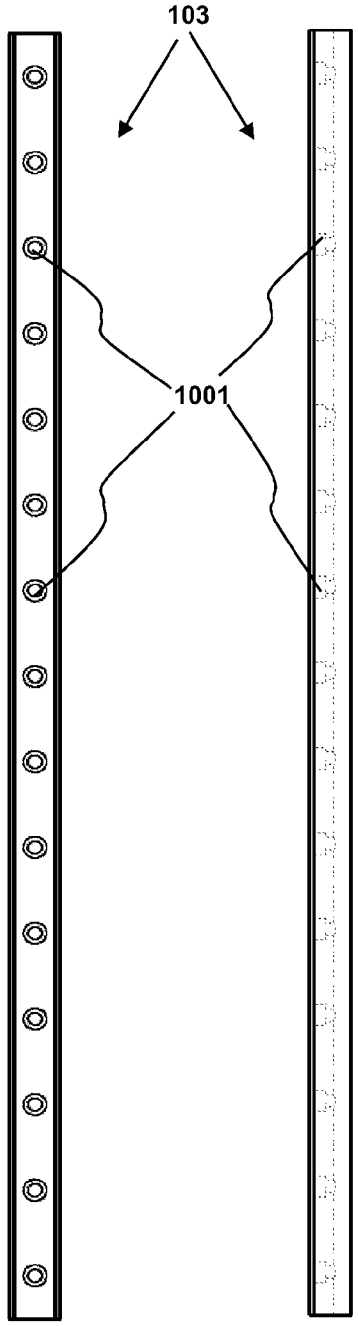
Fig. 10a
Fig. 10b

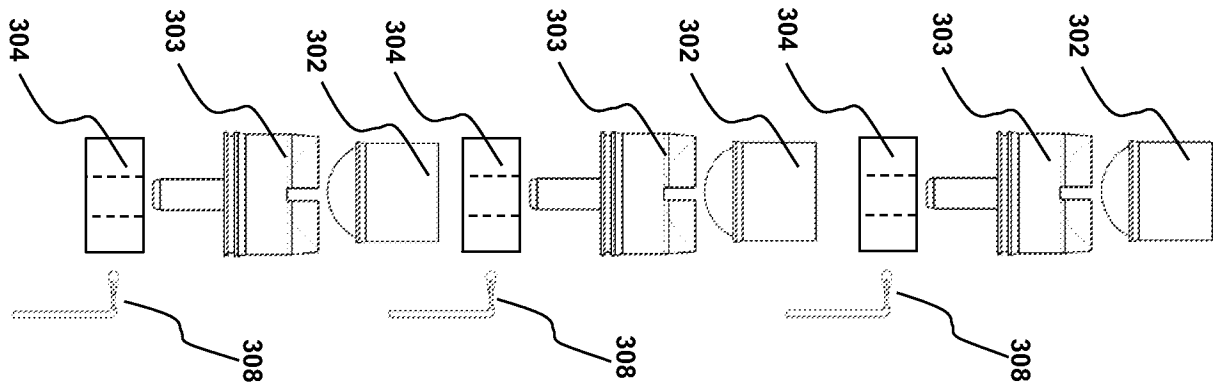
Fig. 15
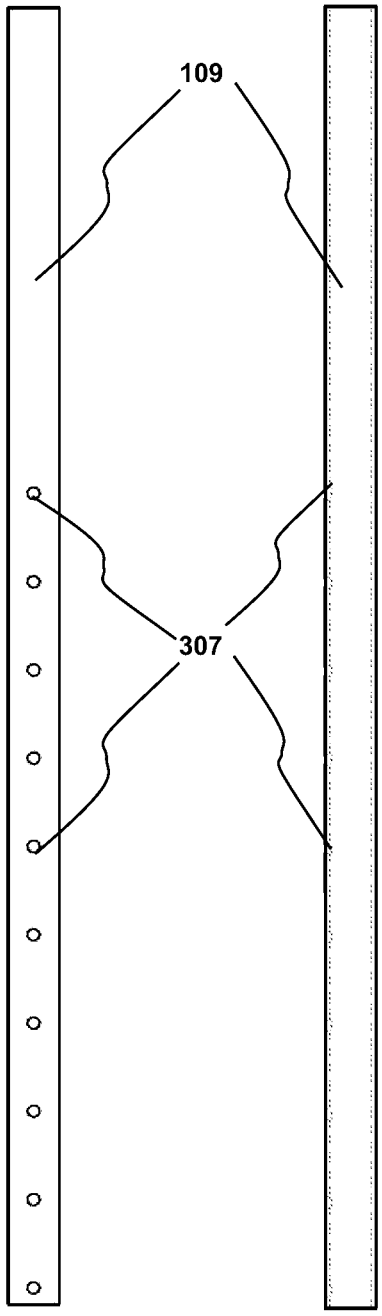
Fig. 16a
Fig. 16b

STACKED ORDNANCE SYSTEMS AND METHODS

CROSS-REFERENCE TO RELATED APPLICATIONS

This application claims the benefit and priority of U.S. Provisional Patent Application 61/931,935 titled "Stacked Ordnance Systems and Methods" and filed on Jan. 27, 2014 which is herein incorporated by reference in its entirety.

TECHNICAL FIELD

Embodiments are generally related to firearms, small arms, mines, and sensors. Embodiments also relate to electronically fired ordnance and to multiple projectiles simultaneously loaded in a single barrel.

BACKGROUND OF THE INVENTION

Stacked projectile firearms have been developed and tested for almost as long as firearms have existed because they provide for multiple firings between loadings. More recently, interest has been rekindled because the concept provides for firearms with few moving parts and electronic control. Systems and methods for providing stacked projectile firearms are needed.

BRIEF SUMMARY

The following summary is provided to facilitate an understanding of some of the innovative features unique to the present invention and is not intended to be a full description. A full appreciation of the various aspects of the embodiments disclosed herein can be gained by taking the entire specification, claims, drawings, and abstract as a whole.

It is therefore an aspect of the embodiments to form a barrel from a first half barrel and a second half barrel. The first half barrel and the second half barrel each have a groove running their length, that groove being half a barrel bore. A gun barrel can be formed by holding the first half barrel and the second half barrel together such that the half bores form a compete bore. The gun barrel has a muzzle, from which projectiles can emerge. The gun barrel can be loaded with stacked ordnance as follows, from back to front: charge, seal, projectile, charge, seal, projectile, and so on. The charges can be accessed and ignited by ignition holes in the gun barrel. Igniters can be placed in the ignition holes to ignite the charges. Igniting the forward most charge fires the forward most projectile out of the muzzle.

It is a further aspect of the embodiments that the first half barrel and the second half barrel are entirely made of plastic. A cylindrical bore liner can protect the bore of the gun barrel from the igniting charges.

It is a yet further aspect of the embodiments that the system can have numerous gun barrels with each gun barrel formed by holding together a first half barrel and a second half barrel. The half barrels can be arranged radially around a backbone with damps clamping the second half barrels to the first half barrels and to the backbone.

BRIEF DESCRIPTION OF THE DRAWINGS

The accompanying figures, in which like reference numerals refer to identical or functionally-similar elements throughout the separate views and which are incorporated in and form a part of the specification, further illustrate the embodiments and, together with the detailed description, serve to explain the embodiments disclosed herein.

FIG. 9 illustrates a backbone for a multi barrel stacked ordnance system in accordance with aspects of the embodiments;

FIGS. 10*a* and 10*b* illustrate a top view and a side view of a clamp for a multi barrel stacked ordnance system in accordance with aspects of the embodiments;

FIG. 15 illustrates an exploded view of a loathing for a stacked ordnance system in accordance with aspects of the embodiments; and FIGS. 16*a* and 16*b* illustrate two views of a bore liner for a stacked ordnance system in accordance with aspects of the embodiments.

DETAILED DESCRIPTION

The particular values and configurations discussed in these non-limiting examples can be varied and are cited merely to illustrate at least one embodiment and are not intended to limit the scope thereof.

A stacked ordnance device provides a disposable and optionally non-reusable projectile weapon. A gun barrel can be formed by holding two half barrels together such that separating the halves exposes the length of the bore. Stacked ordnance devices have multiple projectiles, seals, and charges positioned sequentially in the gun barrel. A controller can electronically trigger igniters that ignite the charges and fire the projectiles. The device can have more than one gun barrel and the gun barrels can be made from plastic. Multi-barrel devices can have gun barrels arranged radially around and clamped to a backbone.

This application claims the benefit and priority of U.S. Provisional Patent Application 61/931,935 (the provisional') titled "Stacked Ordnance Systems and Methods" and filed on Jan. 27, 2014 which is herein incorporated by reference in its entirety. The provisional contains descriptions, drawings, testing data, and images of stacked ordnance systems. It is for those descriptions, drawings, testing data, and images that U.S. Provisional Patent Application 61/931,935 is herein incorporated by reference in its entirety.

Figure 1:
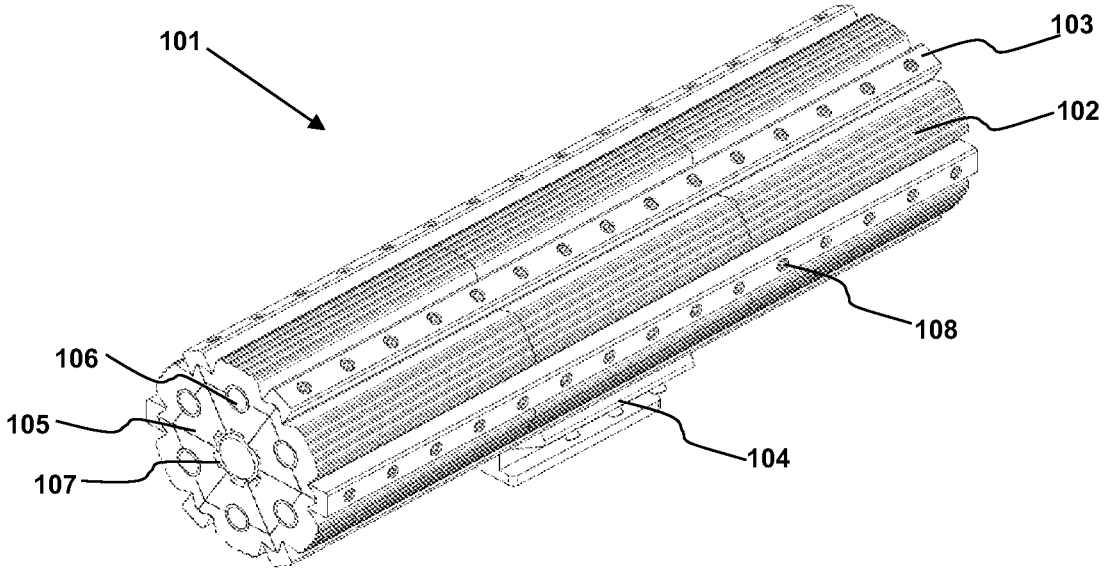
FIG. 1 illustrates a six barrel stacked ordnance system in accordance with aspects of the embodiments.

FIG. 1 illustrates a six barrel stacked ordnance system 101 in accordance with aspects of the embodiments. The gun barrels are arranged radially around backbone 107. The second half barrels 105 are arranged radially around the backbone 107 with each second half barrel 105 paired with a first half barrel 102 to form gun barrels with muzzles 106. Clamp bolts 108 connect clamps 103 to the backbone 107. The clamps 103 and the backbone 107 clamp the barrel halves together to form gun barrels. A base 104 is attached to the bottom of the stacked ordnance system 101.

Figure 2:
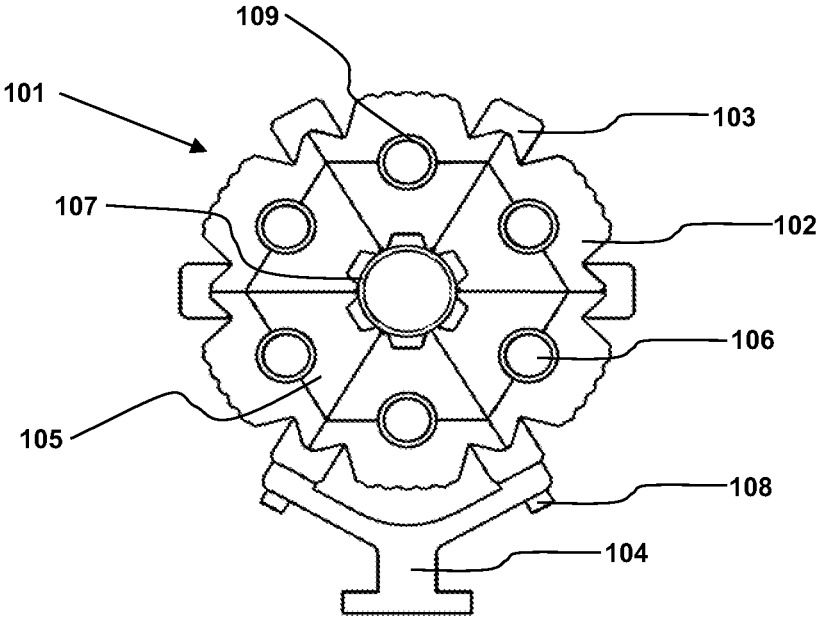
FIG. 2 illustrates a front view of the six barrel stacked ordnance system of FIG. 1 in accordance with aspects of the embodiments.

FIG. 2 illustrates a front view of the six barrel stacked ordnance system 101 of FIG. 1 in accordance with aspects of the embodiments. A bore liner 109 can be seen within the gun barrel as can the damp bolts 108 holding the base 104 to the stacked ordnance system 101.

Figure 3:
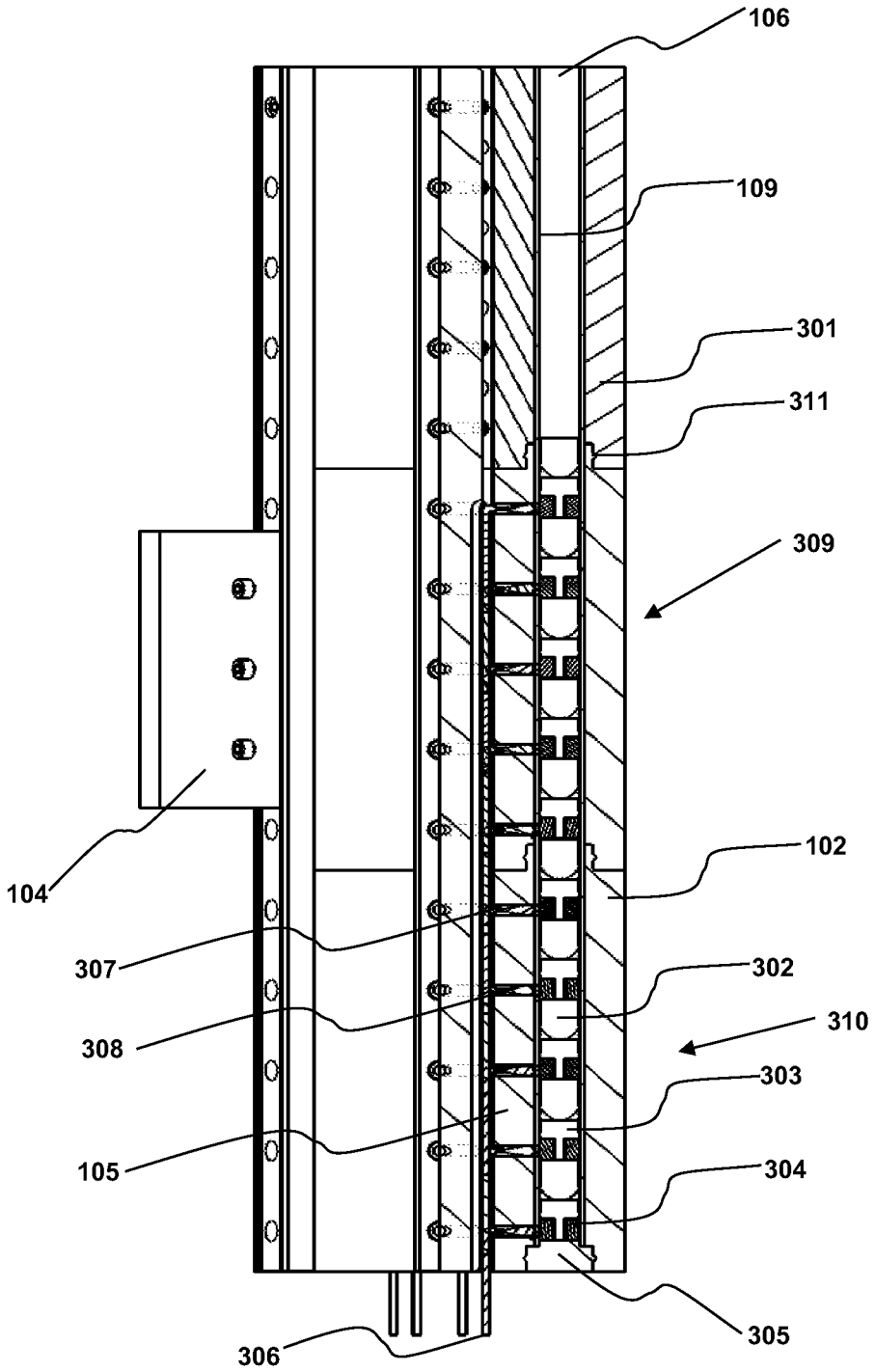
FIG. 3 illustrates a side view of the six barrel stacked ordnance system of FIG. 1 in accordance with aspects of the embodiments.

FIG. 3 illustrates a side view of the six barrel stacked ordnance system in accordance with aspects of the embodiments. Each barrel is illustrated as loaded with a stack of charges 304, seals 303, and projectiles 302. Furthermore, each gun barrel has three sections. The front most section 301 is not loaded, has no ignition holes 307, and supports the bore liner 109. The middle section 309 is loaded with five charges 304 and is formed from a first half barrel 102 clamped to a second half barrel 105. The back section 310 is loaded with five charges 304 and is also formed from a first half barrel 102 damped to a second half barrel 105. The back section 310 is terminated with a barrel plug 305. The three sections are held together by barrel interfaces 311 as well as by the damps, clamp bolts, and backbone. The second half barrels 105 have igniter holes 307 holding igniters 308. The igniters can be electronically fired through ignition wires 306.

Figure 4:
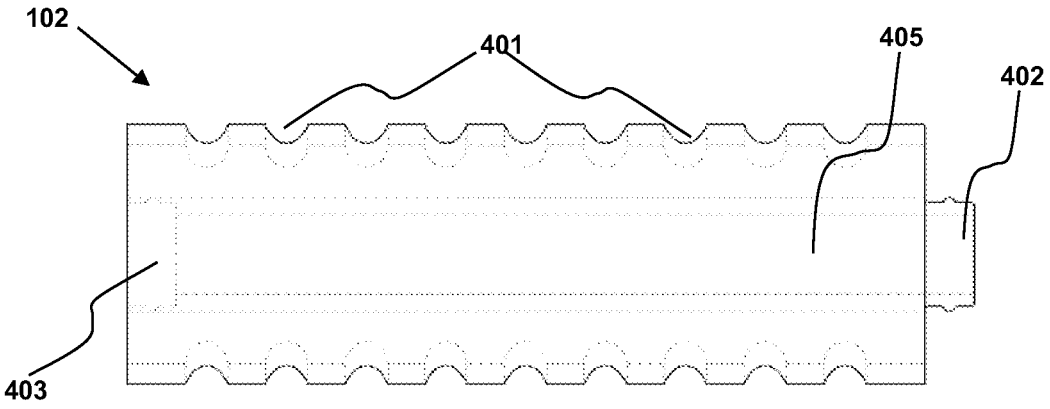
FIG. 4 illustrates a top view of a first half barrel in accordance with aspects of the embodiments.

FIG. 4 illustrates a top view of a first half barrel 102 in accordance with aspects of the embodiments. The first half barrel 102 and the second half barrel 105 have bolt grooves 401. Bolt holes are formed when the bolt grooves 401 of one half barrel are properly aligned with the bolt grooves 401 of another half barrel. The damp bolts 108 can pass through the bolt holes formed by the bolt grooves 401. The first half barrel 102 has barrel interface portions 402, 403 for forming barrel interfaces 311. The front barrel portion 402 can interface with the back portion 403 of a different first half barrel 102. The first half bore 405 can be seen running the length of the first half barrel 102.

Figure 5:
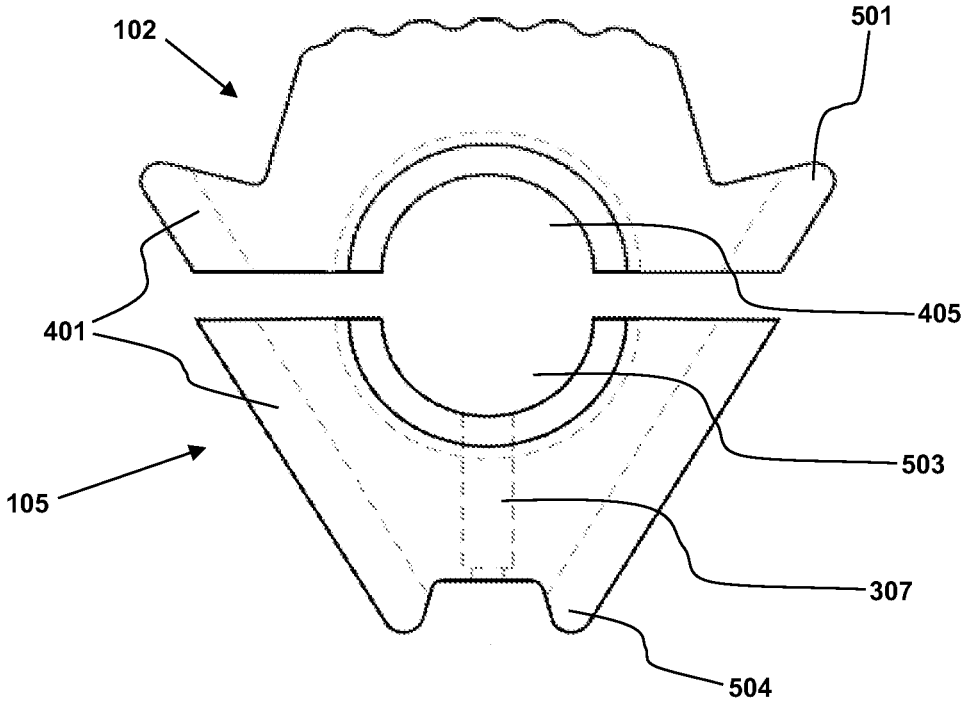
FIG. 5 illustrates front views of a first half barrel and a second half barrel in accordance with aspects of the embodiments.

FIG. 5 illustrates a rear view of a first half barrel 102 over a second half barrel 105 in accordance with aspects of the embodiments. The half barrels are not in contact and therefore do not yet form a gun barrel. A gun barrel would be formed when the two half barrels 102, 105 are held together such that the first half bore 405 and the second half bore 503 form a bore for the gun barrel. The bolt grooves 401 can be seen to continue from the first half barrel 102 down through the second half barrel 105. An igniter hole 307 is also apparent. The first half barrel 102 has an outer flange 501 that interfaces with clamp 103. The second half barrel has inner flange 504 that interfaces with backbone 107.

Figure 6:
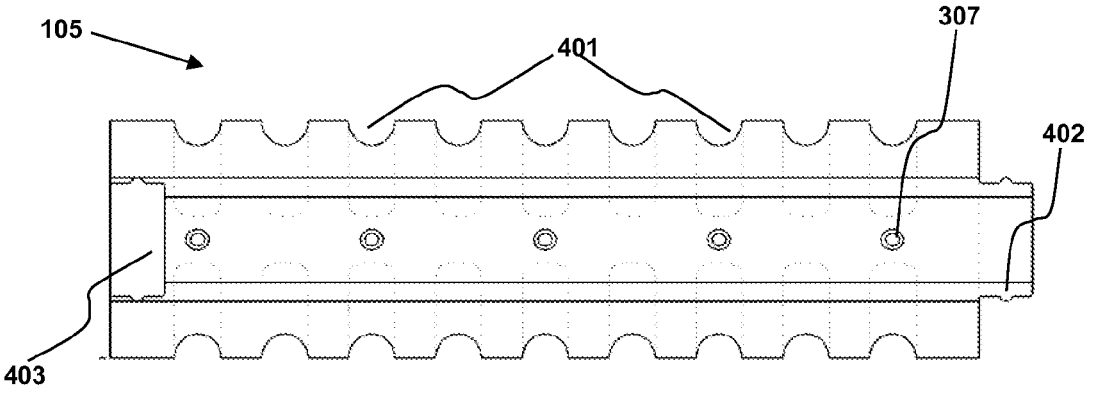
FIG. 6 illustrates a bottom view of a second half barrel in accordance with aspects of the embodiments.

FIG. 6 illustrates a bottom view of a second half barrel 105 in accordance with aspects of the embodiments. The bolt grooves 401 and interface portions 402, 403 are similar to those of the first half section 102. Igniter holes 307 provide access to the charges so that the weapon can be discharged.

Figure 7:
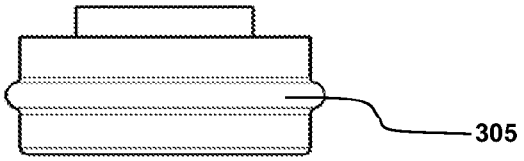
FIG. 7 illustrates a side view of a barrel plug in accordance with aspects of the embodiments.
Figure 8:
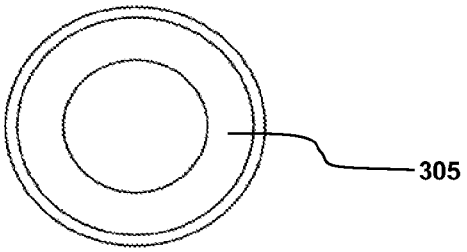
FIG. 8 illustrates a front view of a barrel plug in accordance with aspects of the embodiments.

FIGS. 7 and 8 illustrate a side view and a front view, respectively, of a barrel plug 305 in accordance with aspects of the embodiments. The barrel plug 305 plugs the back of a gun barrel or backmost gun barrel section 310.

FIG. 9 illustrates a backbone 107 for a multi barrel stacked ordnance system 101 in accordance with aspects of the embodiments. The backbone 107 has numerous tapped bolt holes 901 into which the clamp bolts 108 can be threaded. As discussed above, the clamp bolts 108 can tighten the clamp 103 to the backbone 107 such that properly positioned first half barrels 102 and second half barrels 105 are clamped together to from gun barrels. The backbone 107 is illustrated with two sections. One section has grooves 902 that interface with the inner flanges 504 to hold the second half barrels 105 properly in position against the backbone 107 as the clamp 103 is tightened by tightening the clamp bolts 108.

FIG. 10 illustrates a top view (FIG. 10*a*) and a side view (FIG. 10*b*) of a clamp 103 for a multi barrel stacked ordnance system 101 in accordance with aspects of the embodiments, The clamps 103 are illustrated as having numerous countersunk holes 1001 through which the clamp bolts 108 can pass.

Figure 11:
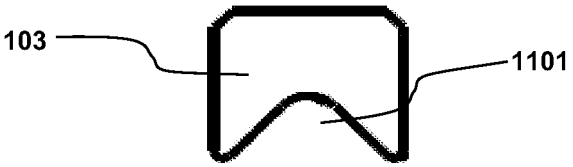
FIG. 11 illustrates a side view of a damp for a multi barrel stacked ordnance system in accordance with aspects of the embodiments.

FIG. 11 illustrates a side view of a clamp 103 for a multi barrel stacked ordnance system 101 in accordance with aspects of the embodiments. The clamp 103 has a groove 1101 that interfaces with the outer flanges 501 of the first half barrels 102.

Figure 12:
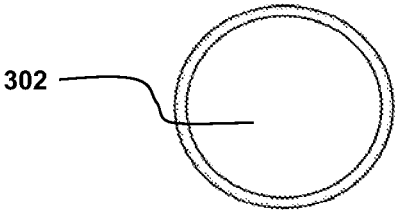
FIG. 12 illustrates a front view of a projectile for a stacked ordnance system in accordance with aspects of the embodiments.

FIG. 12 illustrates a front view of a projectile 302 for a stacked ordnance system 101 in accordance with aspects of the embodiments.

Figure 13:
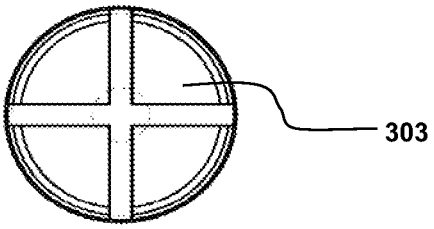
FIG. 13 illustrates a front view of a seal for a stacked ordnance system in accordance with aspects of the embodiments.

FIG. 13 illustrates a front view of a seal 303 for a stacked ordnance system 101 in accordance with aspects of the embodiments.

Figure 14:
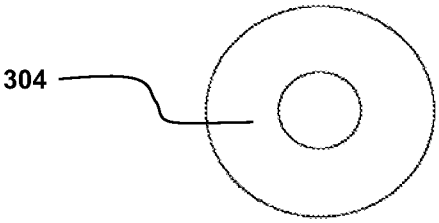
FIG. 14 illustrates a front view of a charge for a stacked ordnance system in accordance with aspects of the embodiments.

FIG. 14 illustrates a front view of a charge 304 for a stacked ordnance system 101 in accordance with aspects of the embodiments.

FIG. 15 illustrates an exploded view of a loading for a stacked ordnance system 101 in accordance with aspects of the embodiments. Each projectile 302 is followed by a seal 303 which is followed by a charge 304. An igniter 308 can ignite the charge 304 which fires the projectile 302 and seal 303 out the muzzle 106 of a gun barrel. The igniters can be electronically fired by a controller.

FIGS. 16*a* and 16*b* illustrate two views of a bore liner 109 for a stacked ordnance system 101 in accordance with aspects of the embodiments. Bore liners 109 can protect the insides of the gun barrels and can be crucial for proper and safe operation of the stacked ordnance system 101 when the first half barrel 102 and the second half barrel 105 are made of plastic or aluminum. The bore liners 109 have ignition holes 307 to provide access to the charges 304 such that the weapon can be fired.

It will be appreciated that variations of the above-disclosed and other features and functions, or alternatives thereof, may be desirably combined into many other different systems or applications. Also, that various presently unforeseen or unanticipated alternatives, modifications, variations or improvements therein may be subsequently made by those skilled in the art which are also intended to be encompassed by the following claims.

What is claimed is:

1. A system comprising:

a first half barrel comprising a first half bore;

a second half barrel comprising a second half bore and a plurality of igniter holes;

wherein the first half barrel and the second half barrel are held together to thereby form a gun barrel comprising a bore and a muzzle;

wherein the first half bore and the second half bore form the bore, the bore configured to hold a plurality of charges, a plurality of seals, and a plurality of projectiles with the seals and projectiles separating the charges;

wherein the igniter holes provide access for igniting the charges;

wherein igniting the charge nearest the muzzle fires the projectile nearest the muzzle out of the barrel;

a plurality of first half barrels wherein the first half barrel is one of the first half barrels;

a plurality of second half barrels wherein the second half barrel is one of the second half barrels; and a backbone wherein the first half barrels are radially arranged around the backbone, and wherein the second half barrels are radially arranged around the first half barrels to thereby form a plurality of gun barrels that are radially arranged around the backbone wherein the gun barrel is one of the gun barrels.

2. The system of claim 1 wherein the first half barrel and the second half barrel are made entirely of plastic.

3. The system of claim 1 further comprising a bore liner that protects the first half bore and the second half bore from the charges when the charges are ignited.

4. The system of claim 1 further comprising the plurality of charges, the plurality of seals, and the plurality of projectiles.

5. The system of claim 4 further comprising a plurality of igniters positioned to ignite the charges.

6. The system of claim 1 further comprising a plurality of clamps that clamp the second half barrels to the first half barrels to thereby form the gun barrels.

7. The system of claim 6 wherein the clamps also clamp the gun barrels to the backbone.

8. The system of claim 1 further comprising a bore liner that protects the first half bore and the second half bore from the charges when the charges are ignited.

9. A system comprising:

a plurality of first half barrels and first half bores with each of first half barrels comprising one of the first half bores;

a plurality of second half barrels and second half bores with each of second half barrels comprising one of the second half bores and a plurality of igniter holes;

a backbone wherein the first half barrels are radially arranged around the backbone, and wherein the second half barrels are radially arranged around the first half barrels to thereby form a plurality of gun barrels, each comprising a bore and a muzzle; and a plurality of clamps that clamp the gun barrels to the backbone wherein the gun barrels are radially arranged around the backbone;

wherein each bore is configured to hold a plurality of charges, a plurality of seals, and a plurality of projectiles with the seals and projectiles separating the charges;

wherein the igniter holes provide access for igniting the charges; and wherein igniting the charge nearest the muzzle of any one of the barrels fires the projectile nearest that muzzle out of that one of the barrels.

10. The system of claim 9 wherein the first half barrels and the second half barrels are made entirely of plastic.

11. The system of claim 9 further comprising a bore liner that protects the first half bores and the second half bores from the charges when the charges are ignited.

12. The system of claim 9 further comprising the plurality of charges, the plurality of seals, and the plurality of projectiles.

13. The system of claim 12 further comprising a plurality of igniters positioned to ignite the charges.

* * * * *